US008066621B2

(12) United States Patent
Carlson

(10) Patent No.: US 8,066,621 B2
(45) Date of Patent: Nov. 29, 2011

(54) EXERCISE APPARATUS HAVING A USER INTERFACE WHICH CAN MOVE ARCUATELY IN THREE DIMENSIONS

(76) Inventor: Alan L. Carlson, Lago Vista, TX (US)

( * ) Notice: Subject to any disclaimer, the term of this patent is extended or adjusted under 35 U.S.C. 154(b) by 871 days.

(21) Appl. No.: 10/367,395

(22) Filed: Feb. 14, 2003

(65) Prior Publication Data

US 2004/0033869 A1 Feb. 19, 2004

Related U.S. Application Data

(63) Continuation-in-part of application No. 10/219,976, filed on Aug. 15, 2002, now Pat. No. 7,104,926.

(51) Int. Cl.
*A63B 21/00* (2006.01)

(52) U.S. Cl. ..... 482/8; 482/139; 482/127

(58) Field of Classification Search ..... 482/907, 482/79, 80, 93, 98–102, 120, 8, 139, 114
See application file for complete search history.

(56) References Cited

U.S. PATENT DOCUMENTS

| | | | | |
|---|---|---|---|---|
| 1,707,791 | A * | 4/1929 | Anderson | 482/72 |
| 3,205,303 | A | 9/1965 | Bradley | |
| 3,290,985 | A | 12/1966 | Bains | |
| 4,149,713 | A * | 4/1979 | McLeod | 482/101 |
| 4,219,193 | A | 8/1980 | Newman | |
| 4,278,249 | A | 7/1981 | Forrest | |
| 4,537,393 | A | 8/1985 | Kusch | |
| 4,583,731 | A | 4/1986 | Crivello | |
| 4,586,515 | A | 5/1986 | Berger | |
| 4,640,268 | A * | 2/1987 | Roberts | 601/24 |
| 4,645,198 | A | 2/1987 | Levenston | |
| 4,768,779 | A | 9/1988 | Oehman | |
| 4,845,987 | A | 7/1989 | Kenneth | |
| 4,872,668 | A * | 10/1989 | McGillis et al. | 482/113 |
| 4,893,808 | A | 1/1990 | McIntyre | |
| 4,954,815 | A | 9/1990 | Delmonte | |
| 5,116,359 | A | 5/1992 | Moore | |
| 5,178,160 | A * | 1/1993 | Gracovetsky et al. | 600/595 |
| 5,252,070 | A | 10/1993 | Jarrett | |
| 5,324,247 | A | 6/1994 | Lepley | |
| 5,336,138 | A | 8/1994 | Arjawat | |

(Continued)

FOREIGN PATENT DOCUMENTS

FR 2661333 A1 10/1991

*Primary Examiner* — Jerome W Donnelly
(74) *Attorney, Agent, or Firm* — Alan Carlson

(57) ABSTRACT

A method and system for exercising areas of the body such as the neck, the wrist, the ankle, and the torso which require a wide range of motion and effective resistance over this range. A first member can rotate in relation to a frame and a user interface (second member) is moveable in relation to the first member. As a user pushes on the user interface in any of an X-Y direction the user interface travels in a controlled arcuate three-dimensional motion. The user interface is attached to a lead (rope or cable) which holds the user interface at a rest position and also provides a force on the user interface in the opposite direction of the users force. The lead is attached to an adjustable resistive system and/or a damping system that resists the movement of the sliding assembly. The lead spools in and out of from a central location through a fairlead. Many mechanical configurations can be utilized to allow the user interface to travel in an arcuate path in the direction which it is pushed.

21 Claims, 18 Drawing Sheets

U.S. PATENT DOCUMENTS 5,577,981 A 11/1996 Jarvik
5,643,162 A * 7/1997 Landers et al. ..... 482/131
5,713,370 A * 2/1998 Cook ..... 600/595
5,902,214 A * 5/1999 Makikawa et al. ..... 482/4
5,984,836 A 11/1999 Casali
5,997,440 A 12/1999 Hanoun
6,004,247 A * 12/1999 Webber ..... 482/100
6,106,437 A 8/2000 Brooks
6,551,214 B1 4/2003 Taimela
6,599,757 B1 7/2003 Murai
6,921,352 B1 * 7/2005 Stearns ..... 482/44
6,988,977 B2 * 1/2006 Webber et al. ..... 482/100
2002/0016561 A1 2/2002 Prinsloo
2003/0148863 A1 8/2003 Thomas
2004/0220500 A1 11/2004 Dahl

* cited by examiner

EXERCISE APPARATUS HAVING A USER INTERFACE WHICH CAN MOVE ARCUATELY IN THREE DIMENSIONS

RELATED APPLICATIONS

This application is a continuation-in part of copending and commonly assigned patent application entitled "Exercising Machine for Working Muscles the Support the Spine" Ser. No. 10/219,976 filed Aug. 15, 2002 now U.S. Pat. No. 7,104, 926.

FIELD OF THE INVENTION

This invention relates to exercise equipment for the human body and more importantly to an exercise apparatus that can provide movement of a user interface over a three dimensional arcuate surface. The invention further relates to an exercise device that can exercise all muscles, ligaments and tendons that surround a bone socket.

BACKGROUND OF THE INVENTION

Exercise has become an important part of life in the civilized world. It has been proven that exercise can increase longevity, can rehabilitate injuries, can prevent injuries, can improve athletic performance, and can improve the way of life for many. Current exercise methods and apparatuses provide less-than-perfect performance for exercising certain body parts. More particularly, body parts that have a full range of motion have portions of the motion (directions of movement) that cannot be properly or safely loaded by a force during exercise. For example, current exercise apparatuses do not provide an effective multidirectional loaded movement for exercising the neck, wrist, lower back, shoulder, etc. Many joints such as the wrist and ankle bend, pronate and rotate. It is difficult if not impossible to exercise these parts of the body under load throughout their entire range of motion because these portions of the body move in almost all directions about a bone/socket arrangement or a vertebra-ligament-disk configuration. For example, the wrist can partially exercised by holding a barbell with the fingers and rotating the wrist but the current art lacks a controlled and uniform motion and load which allows a wrist to move under load in a 360-degree rotation during pronation or other complex movement about the wrist joint. An additional shortcoming with modern exercise equipment is that uncontrolled force in awkward positions or uncontrolled joint movements can cause injury. Although humans can move most joints 360 degrees, certain areas or ranges of movement are weak and too much load at a particular location and in a particular direction can tear connective tissue such as muscles ligaments and tendons. For example, during exercise with free weights, if the weight is too heavy or if the weight pulls the user into an awkward position, an exercise apparatus can easily tear muscles, tendons or ligaments causing injury. Thus, controlling the motion of the exercise, the direction of movement, the velocity of movement and amount and direction of the force during the exercise can prevent injuries, yet exercise regions that are currently dangerous to exercise and thus underserved. The present invention also allows the user to move to a rest position (position with no net force) after an exercise is over which is in the normal range of motion after exercise is complete, eliminating the need to "drop the weights". There are also shortcomings in evaluating athletic performance during these non-traditional motions and positions.

SUMMARY

The present invention provides a method and system for exercising areas of the body such as the neck, the wrist, the ankle, and the torso that here-to-fore were very difficult if not impossible to effectively exercise because of the required range of motion and effective resistance to a users movements in three dimensions. A first member can rotate in relation to a frame and a user interface (second member) is moveable in relation to the first member. The user interface can be attached to a lead (rope or cable) which provides a force on the user interface in the opposite direction of the users force. The lead is attached to the user interface and a damping system that resists the movement of the user interface. The lead spools in and out of from a central location through a fairlead. As a user pushes on the user interface in any of an X-Y direction the user interface travels in a controlled arcuate three-dimensional motion. Many mechanical configurations can be utilized to allow the user interface to travel in an arcuate path in the direction which it is pushed. It is preferable that the path of the user interface corresponds to the rotation of the users push point about his bone socket or vertebra pivot. One way to implement the arcuate path is to place the pivot(s) of the mechanical members on the same plane (X and/or Y plane) as the users joint to be exercised. Other mechanical configurations can be implemented which act as though the have a pivot point (a virtual pivot point) on the X-Y plane but in fact the pivot points do not have to be on the X-Y plane. The force exerted by the user can measured over the entire range of motion using a strain gauge or a pressure gauge and position sensors. In another embodiment the fairlead and resistive system is placed on a third member which allows the fairlead to be moved thus changing the rest position of the user interface and the start location for the exercise. In one embodiment the location of the user interface in relation to the pivot points can be adjusted and thus the path traveled by the user interface can be modified.

DETAILED DESCRIPTION

The present invention provides resistance to movement of a user interface over a three dimensional arcuate path during exercise. A user positions himself in an exercise apparatus such that his bone socket or vertebra to be exercised is at the center point of an "imaginary" three-dimensional surface traveled by the user interface. As the user pushes on the user interface (in any all directions in the X-Y plane) the user interface travels in an arcuate three-dimensional motion about the joint or vertebra being exercised. Thus, the part of the body that engages the user interface will move in unison with the user interface to any point on the "imaginary" arcuate surface while a resistive system provides a uniform resistance to a users movement.

Figure 1:
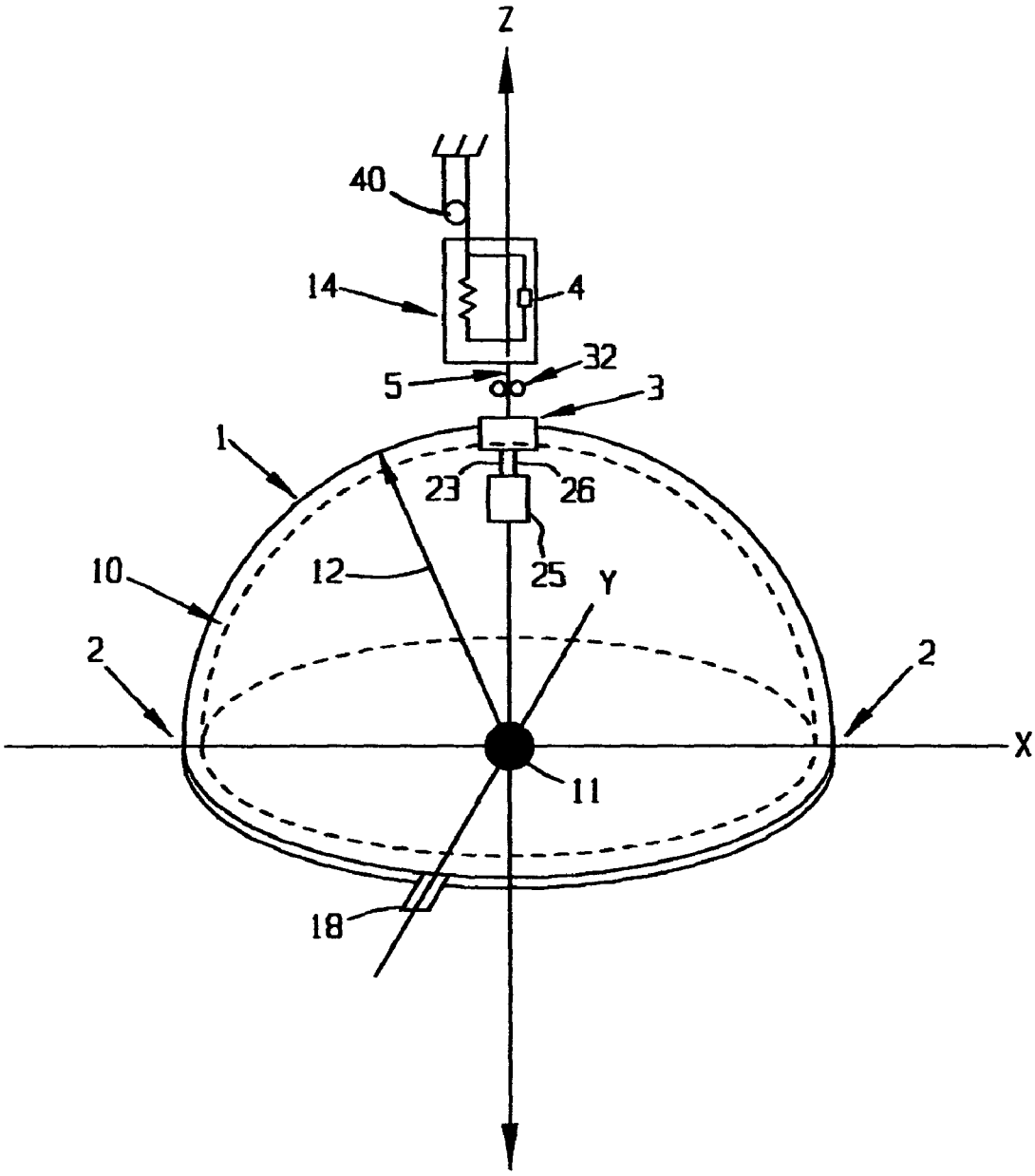
FIG. 1 illustrate one embodiment of an exercising apparatus having a rotatable arcuate track and a sliding assembly for movement of a user interface over an a three dimensional arcuate range of motion.
Figure 2:
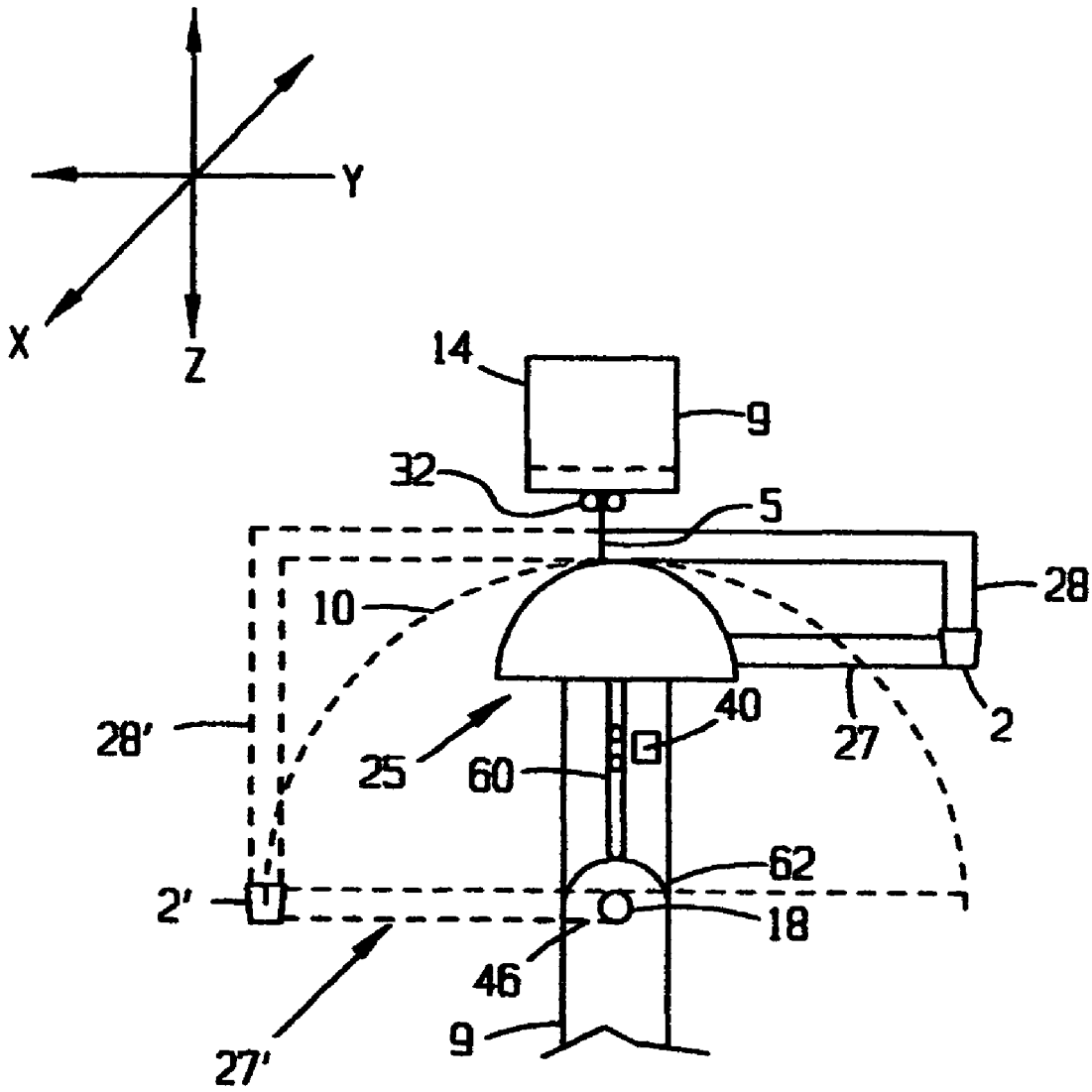
FIG. 2 depicts a front view of another embodiment having mechanical members (first and second pivotable members) which produce controlled movement over an arcuate surface.
Figure 3:
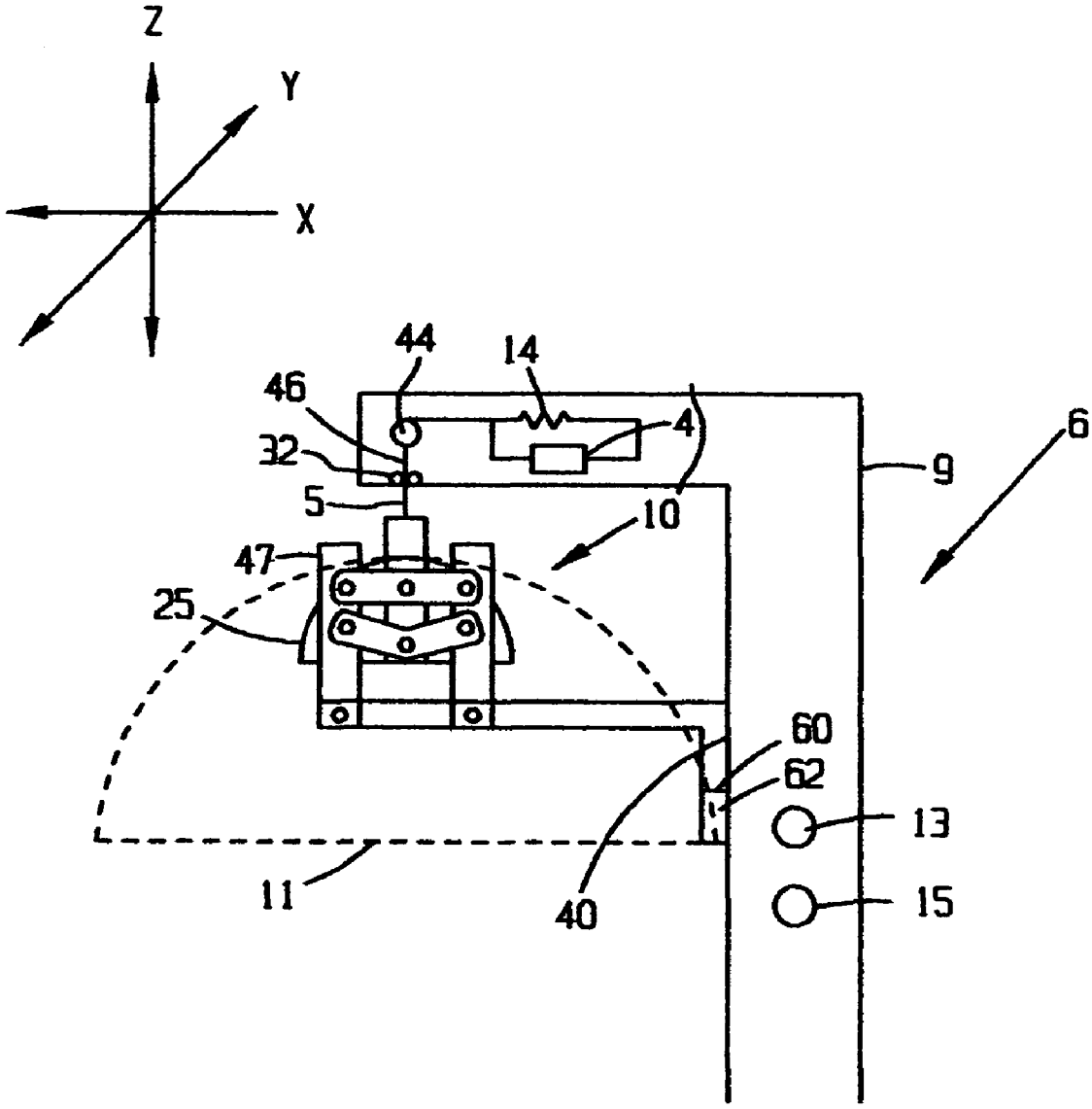
FIG. 3 is a side view illustrating an embodiments having mechanical members which can produce a three dimensional arcuate path.

Referring to FIG. 1 an "imaginary" arcuate surface 10 (shown by a dashed line) is included to illustrate the range and path of movement of a user interface 25. The arcuate surface 10 is comprised of points in three-dimensional space (X-Y-Z) that are substantially equidistant from a center 11. It may be easier to think of the arcuate surface as the exterior surface of an "upside down bowl." The three dimensional arcuate path of the user interface 25 (defined by a center 11 and a radius 12) can be implemented by different mechanical configurations some of which are illustrated in FIGS. 2 and 3. In a preferred embodiment the user interface 25 is coupled to the resistive system 14 with a cable or lead 5 which holds the user interface 25 in a rest position and resists movement of the user interface from the rest opposition. Lead 5 flows in and out of fairlead 32 during exercise. The user interface 25 is slidable along a first member 1 (a pivotable arcuate track in FIG. 1) in the X direction and the pivotable arcuate track 1 can rotate in the Y direction about pivot points 2 thus allowing the user interface 25 to be pushed to desired location on the "imaginary" surface 10. A frame (not shown) secures the pivot points 2 of the rotatable arcuate track 1 (r-a-track). In one embodiment the user interface 25 can be fixed to the r-a-track 1 and the pivot points 2 can rotate about second pivot 18.

The range and shape of motion of the user interface 25 is not intended to be a limiting factor, the movement of the user interface can be about the entire hemispherical surface or it can be about a partial hemisphere, spherical, parabolic, curved or irregular or regular arcuate surface. In some embodiments the resistive system 14 can include pulleys 40, and damping system 4. Changing the distance from the user interface 25 to the r-a-track 1 with path adjuster 26 can alter the path traveled by the user interface 25. If desired, an adapter 23 can be placed between the user interface 25 and the r-a-track 1. Adapter 23 allows the user interface 25 to rotate in relation to the r-a-track 1 under a spring load and it allows the user interface 25 to move away from the r-a-track during exercise. In FIGS. 1-18 like elements have like callouts.

Figure 1A:
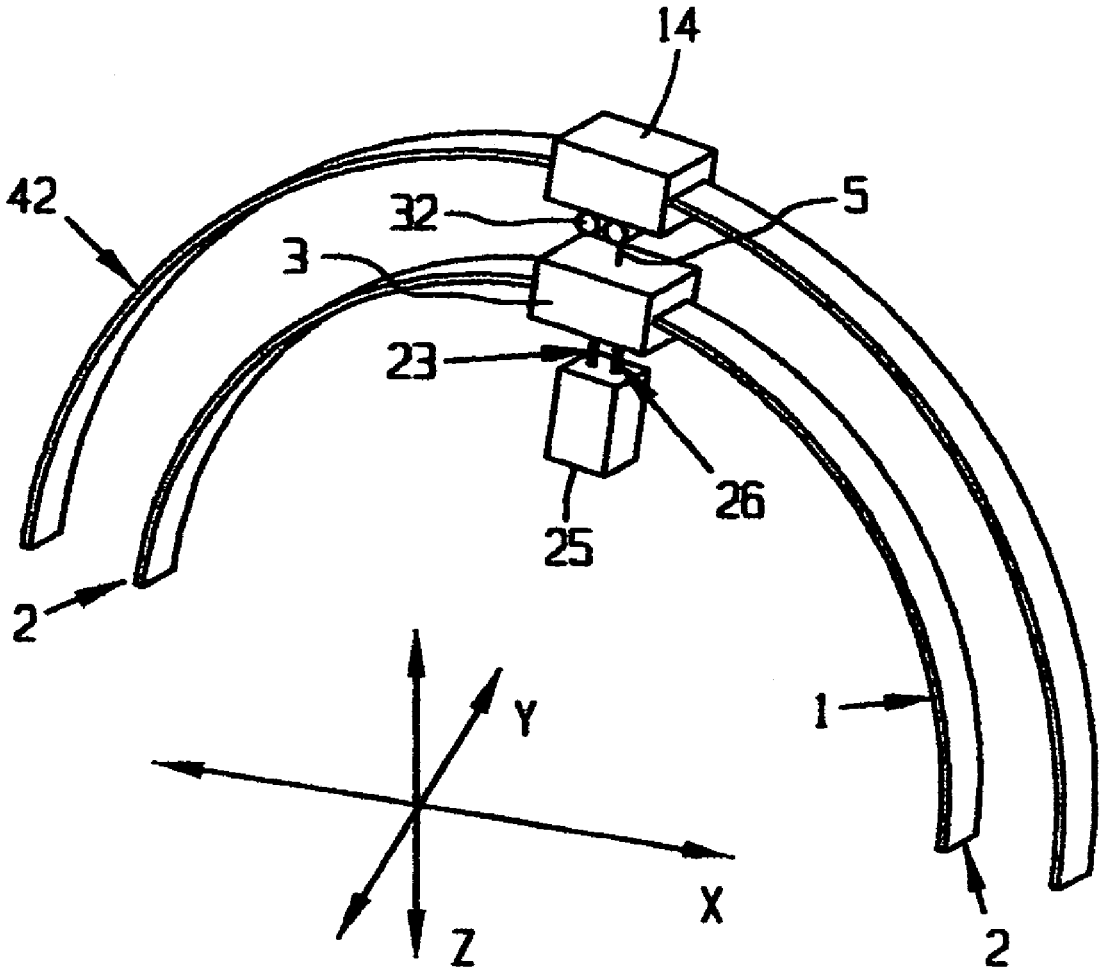
FIG. 1A is an orthogonal view of the rotatable arcuate track (r-a-track) with the slidable assembly and a user interface adapted to slide along a r-a-track.

Referring to FIG. 1A a r-a-track 1 with sliding assembly 3 is illustrated. The r-a-track 1 has pivots 2 about which r-a-track 1 can rotate or pivot. A user interface 25 is coupled to the sliding assembly 3 such that a user can push on, or pull on the user interface 25 during exercise. An adjuster 26 can be utilized to adjust the path of the user interface and the adapter 23 can be utilized to allow the user interface 25 to pivot and slide in relation to the slidable assembly 3. The user interface 25 is coupled to a resistive system 14 via lead 5 which moves through fairlead 32. The lead 5 and the resistive system 14 hold the slidable assembly 3 in a rest position and resist movement of the sliding assembly 3 from the rest position during exercise. Third member 42 (a fairlead track) can be utilized to move the fairlead 32 to a desired location above the imaginary arcuate surface. Movement of the fairlead 32 allows the user to pre-select a starting location for the exercise.

The r-a-track 1 can be made from hard plastic, fiberglass, a composite material or any rigid or semi rigid material. The r-a-track 1 can be made using a flat bar and rolling the flat bar in a roller to create the arc. The ends of the r-a-track 1 can be fitted with ball joints to allow the r-a-track 1 to pivot easily. Exercise apparatuses 6 for different parts of the body may require rotatable arcuate tracks having different dimensions. For example, a r-a-track 1 utilized to exercise a wrist will require a relatively small path arc and thus a different sized r-a-track that the r-a-track for exercising a torso. However, as described above minor path modifications can be made by adjuster 26 because a user having a shorter bone or shorter radius about his pivot point will require a smaller radius of travel than a long boned person.

In one embodiment adjuster 26 can be a low profile scissors mechanism. In another embodiment adjuster 26 can be concentric tubes with an elastic member to force or hold the tubes together. In yet another embodiment the adjuster 26 and the adapter 23 can be combined where the range of movement of the user interface 25 in relation to the slidable assembly 3 can be controlled. If a users movement does not match the arc traveled by the slidable assembly 3 then the adapter 23 can expand or contracts within certain limits to keep the user in contact with the user interface 25. Additionally, the user interface 25 may be allowed to rotate in relation to the slidable assembly 3 to accommodate pronation of the body part. Other embodiment for changing the path traveled in the Y direction by the user interface include moving pivot point 2 on the r-a-track 1 and if the r-a-track 1 is semi-flexible then the pivot points 2 can be moved closer together to change the arc travel in the X direction.

Figure 1B:
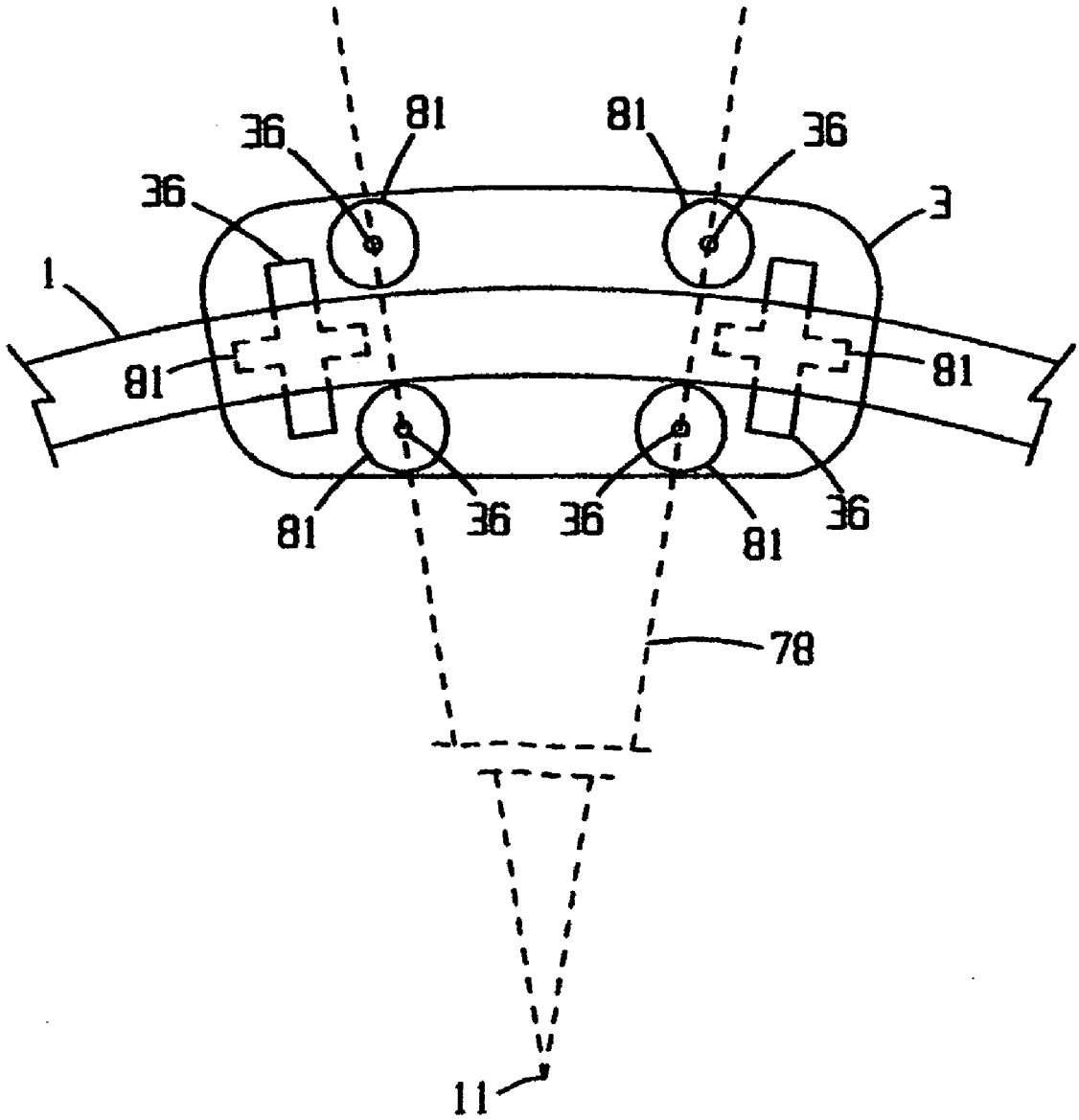
FIG. 1B illustrates a side cut away view of a the sliding assembly illustrated in FIG. 1A.

Referring to FIG. 1B a cutaway view of one embodiment of a slidable assembly 3 is shown mounted on a portion of the r-a-track 1. Axels 36 are placed in the second member or slidable assembly 3 along imaginary radial lines 78 (defined by radius 1) which originate at the center 11 of the "imaginary" arcuate surface 10 (as shown in FIG. 1). Bearings 81 or rollers roll to provide a "frictionless" feel to the user as the second member or sliding assembly 3 moves on the r-a-track 1. The slidable assembly 3 can be manufactured by, punching, welding, milling or drilling steel or aluminum to secure the axles 36 that mount the bearings 81. In one embodiment twelve bearings 81 surround the r-a-track 1 (four bearings on the top side, four on the bottom side and two on each edge of the r-a-track 1).

FIG. 2 illustrates an exercise apparatus 6 having two mechanical configurations for providing movement of a user interface 25 over a three dimensional arcuate surface 10. The user interface 25 is illustrated as a headgear for placement on a users head 4. For one embodiment first and second member 27' and 28' (illustrated by dashed lines) can provide the arcuate motion of the present invention. As a user pushes in the Y direction first member 27' pivots about second pivots 18 and the user interface 25 moves in an arcuate motion which has a Z component as it is forced in the Y direction. Alternately, if the user places a force in the X direction the second member 28' pivots about second pivot point 2' (about first arm 27') and moves down in the Z direction. In certain exercise machines movement of the members 27' and 28' can cause undesirable contact with the user. In the embodiment illustrated by 27', 28' and 2', the X and Y pivot points are located on same plane as the exercisers pivot point. However, pivot points can simulated in some mechanical configurations and the pivot points can be referred to as virtual pivot points.

In another embodiment first and second members illustrated by 27 and 28 (illustrated by solid lines) provide virtual pivot points. A push rod 60 which is coupled to the user interface 25 rides on cam 62. As the user interface 25 is moved, 10 push rod 60 rides on cam 62 wherein the shape of the cam 62 dictates the arcuate path traveled by the user interface in the Y direction. Pivot 2 provides for the arcuate path in the X direction. The frame 9 supports sensors 46, resistance system 14, a friction resistance system 40, lead 5 and fairlead 32.

Referring to FIG. 3 a scissors configuration 47 which has multiple pivot points is illustrated. The scissors configuration 47 can provide an arcuate motion when the user interface 25 moves in the X direction. The scissors configuration 47 also provides a virtual pivot point. Mechanical configurations which reside above or around the user interface 25 and provide a virtual pivot point about the plane of the users joint would not part from the scope and spirit of the present invention. Further combinations of virtual and non-virtual pivot points may be desirable and different combinations of mechanical configurations may be desirable depending on the design considerations. For example, a cam assembly may pivot the user interface 25 in one direction and a scissors configuration for pivoting in another direction.

In the exercise apparatus 6 of FIGS. 1, 2 and 3 described above, a user 4 can push on user interface 25 in nearly any direction and the user interface 25 will provide a controlled movement and a controlled resistance in response to the movement of a body part about its joint or vertebra. Resistance to movement of the user interface 25 from its rest location can be provided by a lead 5 (wire or rope) that is coupled to the user interface 25. The second end of the lead 5 can be attached to a resistive system 14. Resistive system 14 can be a weight, a spring, an elastic cord, a gas charged shock or any other device which can provide a resistance to movement of the lead 5 and can return the user interface 25 to its rest position. The amount of resistance provided by the resistive system 20 can be adjusted by moving first adjuster 13. The lead 5 can be a rope, a cable or a chain and the lead 5 may be routed through pulleys or sprockets 44 prior to attaching to the resistive system 14. The lead 5 should be durable and flexible and it can be made from Kevlar™. The lead 5 feeds through a fairlead 32 and guides the lead 5 as it spools out and recoils in from a central location during exercise. The fairlead 32 can be comprised of four rollers or pulleys forming a "small orifice" to guide the lead 5 from a single location as it follows the user interface 25 during exercise. It is preferred that when the user interface 25 is in its rest position the fairlead 32 is "as close as possible" to the user interface 25. This reduces the amount the user interface 25 before the resistive system 14 provides resistance.

In a preferred embodiment the fairlead 32 can be moved to a predetermined location. Thus, the starting location for the exercise or the rest location of the user interface 25 can be user adjusted. The fairlead 32 and the resistive system 14 can be placed on a third member 42 which is moveable above the imaginary arcuate surface 10. This feature allows the user 4 to start an exercise at any location on the imaginary arcuate surface 10. An adjustable damping system 4 can be implemented to limit the speed and acceleration of the user interface 25 during exercise in all directions. The damping system 4 can be adjusted using second adjuster 15 to slow the movement of the user interface 25 and prevent jerking motions of the user interface 25. The damping system 4 can be comprised of a shock or air cylinder having a bleed orifice or it can be provided by a sprocket or pulley that has a friction device or a mechanism that engages a brake when the rotational velocity of a sprocket becomes too high. A brake which is activated by centrifugal force could be used to prevent high-speed lead movement as the slidable assembly moves on the "imaginary sphere" surface 10.

Sensors 46 can be added to moving parts within the exercise apparatus 6 to analyze complex body motions under load. Three dimensional force vectors can be determined using the sensors data and when the sensor data is combined with sensor data from the users body from ultrasound, magnetic resonance imaging or X rays, complex nerve and muscle activity can be analyzed. The force vectors and muscle and nerve data can be utilized to provide data for diagnosing problems, or injuries and to monitor recovery or responses to the therapy. Knowing the position, force and velocity of a body part in complex motion can give insight into performance, irregular movements of a joint, areas of movement which are weak due to damaged tissue and other phenomena. This data can also be used to analyze current performance and suggest changes in motion or strength conditioning that can increase performance, mobility of flexibility, seriousness of injury, recovery from injury or surgery and to test maximum strength in any given position. Methods for sensing data can be done with position, force, deformation and velocity sensors. A display (not shown) can also be provided to display the force being exerted or the amount of work being preformed during exercise. All of the features described above can be implemented and incorporated in the exercise apparatuses 6 described below in FIGS. 4-18.

Figure 4:
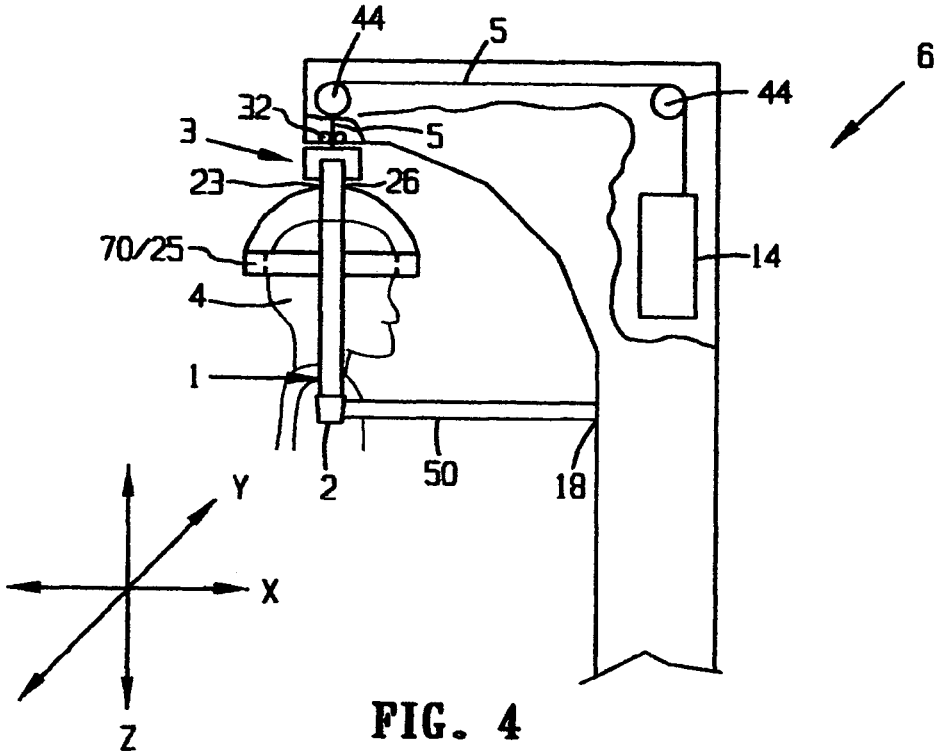
FIG. 4 depicts a front view of an embodiment adapted to exercise the neck region.
Figure 5:
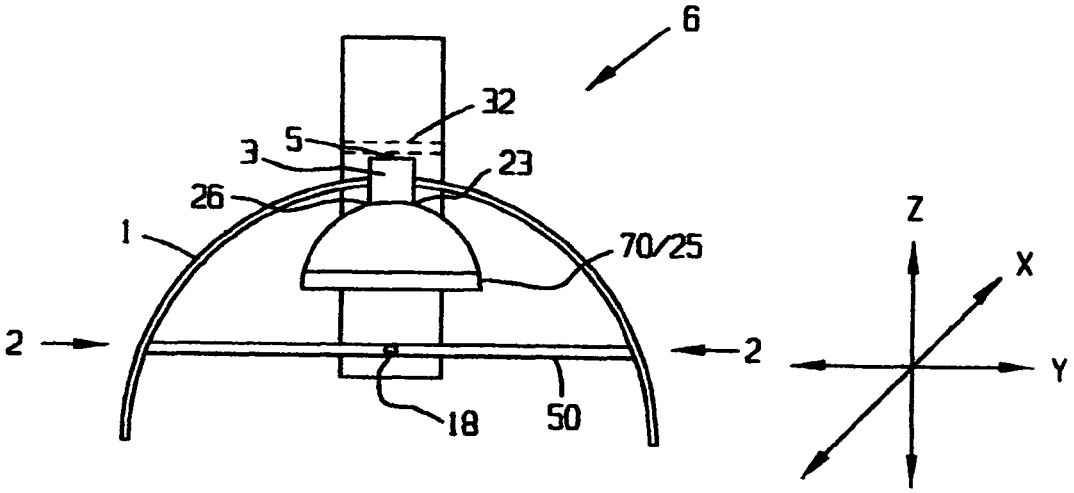
FIG. 5 is a front view further illustrating the embodiment shown in FIG. 4.

FIG. 4 is a side view and FIG. 5 is a front view of an exercise apparatus 6 having an arcuate track which is adapted to exercise the muscles, ligaments and tendons surrounding the vertebra in the neck region. Although an arced track is illustrated all of the mechanical configurations described above could alternately be used for exercising the neck without parting from the scope and spirit of the present invention. The r-a-track 1 (substantially a semicircle or portion or a circle) is pivotable about its ends (pivot points 2) which are secured by frame 9 and retains a slidable assembly 3 that can slide on the r-a-track 1. In all embodiments the frame 9 refers any rigid member which supports static and moving mechanical members. In this embodiment the r-a-track 1 can be made using steel bar stock measuring ½ inch thick, 1 ½ inch wide by 4.5 feet long. The steel bar can be rolled into a semicircle having a radius of approximately 17 inches. The slidable assembly 3 is secured the r-a-track 1 such that it will only slide along the r-a-track 1 and it will not rotate about the r-a-track 1.

The slidable assembly 3 is coupled to a head engaging apparatus (known universally as the user interface 25). As the user 4 (users head in FIG. 4) pushes on the head engaging apparatus 70 in any X, Y, or X-Y direction the user interface 25 moves from its rest location in an arcuate motion (in the Z direction) and lead 5 is pulled from fairlead 32 as resistive system 14 provides a force in the opposite direction of the users force. As the user 4 rotates his head the pivots and/or moveable assemblies force movement of the user interface 25 in an arcuate path rotating about the users joint in the Z direction. Alternately described, when a users force moves the user interface 25 the point of contact between the user 4 and the user interface 25 will be maintain and minimal slippage will occur between these surfaces as a user rotates his head 4 about the base of the neck. As discussed above the sliding assembly 3 can be fixed to first member (the r-a-track) and the fork 50 can rotate about pivot 18 or a virtual pivot point to provide the arcuate motion.

Figure 6:
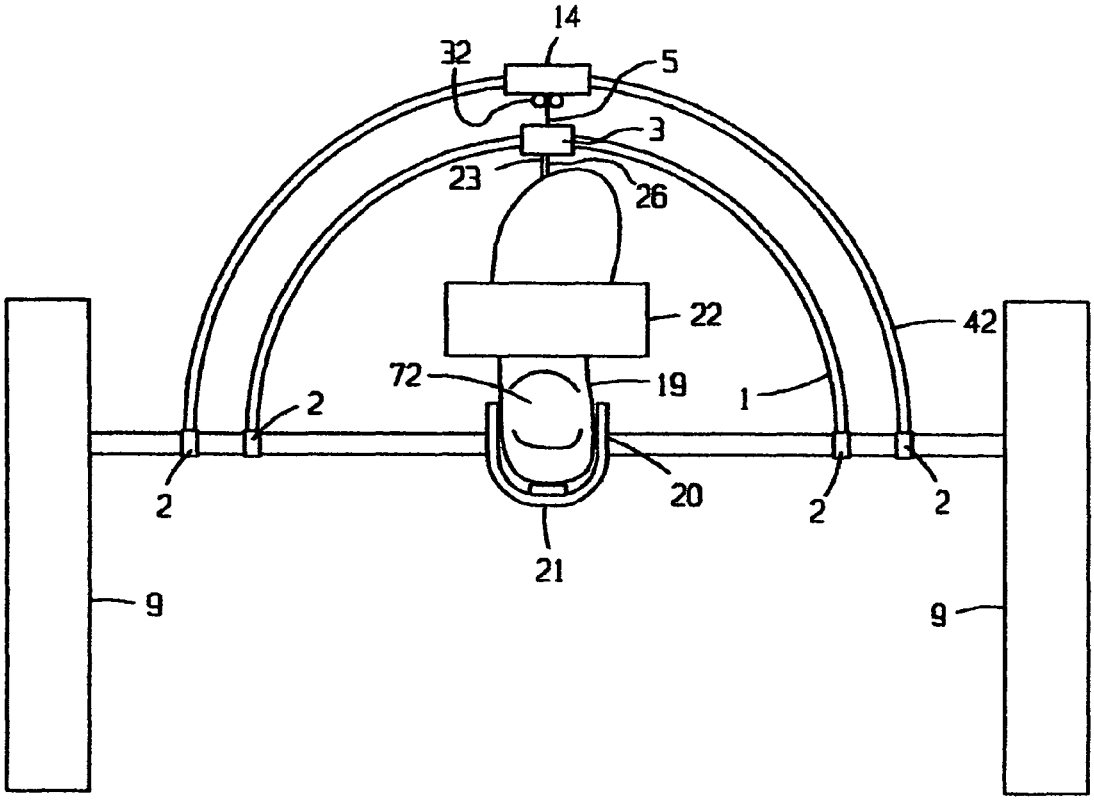
FIG. 6 depicts a top view of an embodiment adapted to exercise the ankle region.
Figure 7:
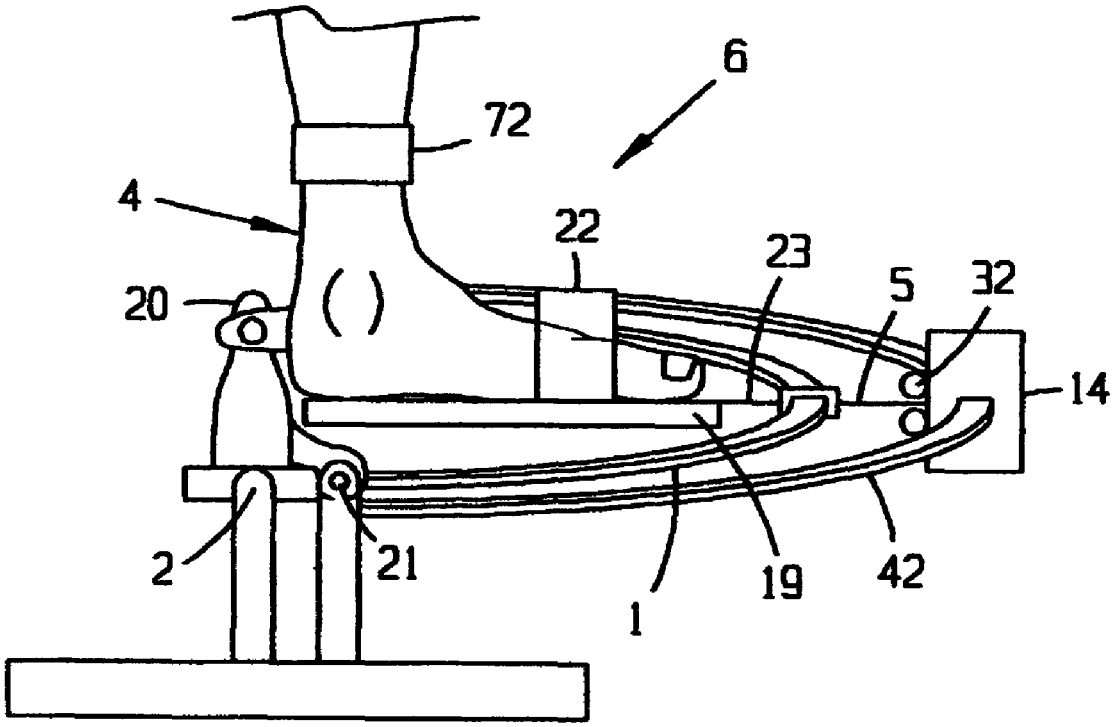
FIG. 7 is a top view further illustrating the embodiment shown in FIG. 6.

FIG. 6 is a top view and FIG. 7 is a side view of an exercise apparatus 6 that uses an arcuate track for exercising the muscles and tendons that surround the ankle socket. In this embodiment the radius of the r-a-track 1 can be on the order of thirteen inches. The r-a-track 1 is supported above the ground by frame 9 such that a pivot plate 19 (universally refer to as the user interface 25) can provide a full ankle rotation without touching the ground. The user can strap his foot to the pivot plate 19 using first retainer 22. Alternately the pivot plate 19 can have an enclosure for inserting the foot (not shown) similar to concept user in the neck exercising embodiment. The first retainer 22 can be a strap or a mechanical member to secure the users foot to the pivot plate 19. X and Y pivot points 20 and 21 are connected to a pivot plate 19 and frame 9 such that the pivot plate 19 pivots substantially about the center of the ankle joint. A second retainer 72 can be used to retain the users leg to the frame 9 above the ankle. Restraining the user on each side of the ankle joint allows the ankle joint to be effectively exercised about the three dimensional arcuate path. The pivot plate 19 can pivot in all directions to follow the motion about the users ankle socket and as in all embodiments the fairlead 42 and the resistive system 14 can be moved along third member 42 to select a predetermined starting location for the exercise. Thus, an exercise can be commenced in a first position where the toes start pointing down and are moved upward during exercise, or an exercise can be commenced in a second position where the toes start pointed up and are pushed downward during exercise. Elastic member 23 allows the pivot plate 19 to rotate in relation to the sliding assembly 3 and r-a-track 1 but places a bias on the pivot plate 19 such that it is in a level position at rest and it resists a torsional motion by the user. The elastic member allows the user 4 to pronate (rotate in two planes) his ankle during exercise and provides resistance to the pronation. This motion can simulate walking or running. Elastic member 23 can be a spring or a flexible rubber connector.

Figure 8:
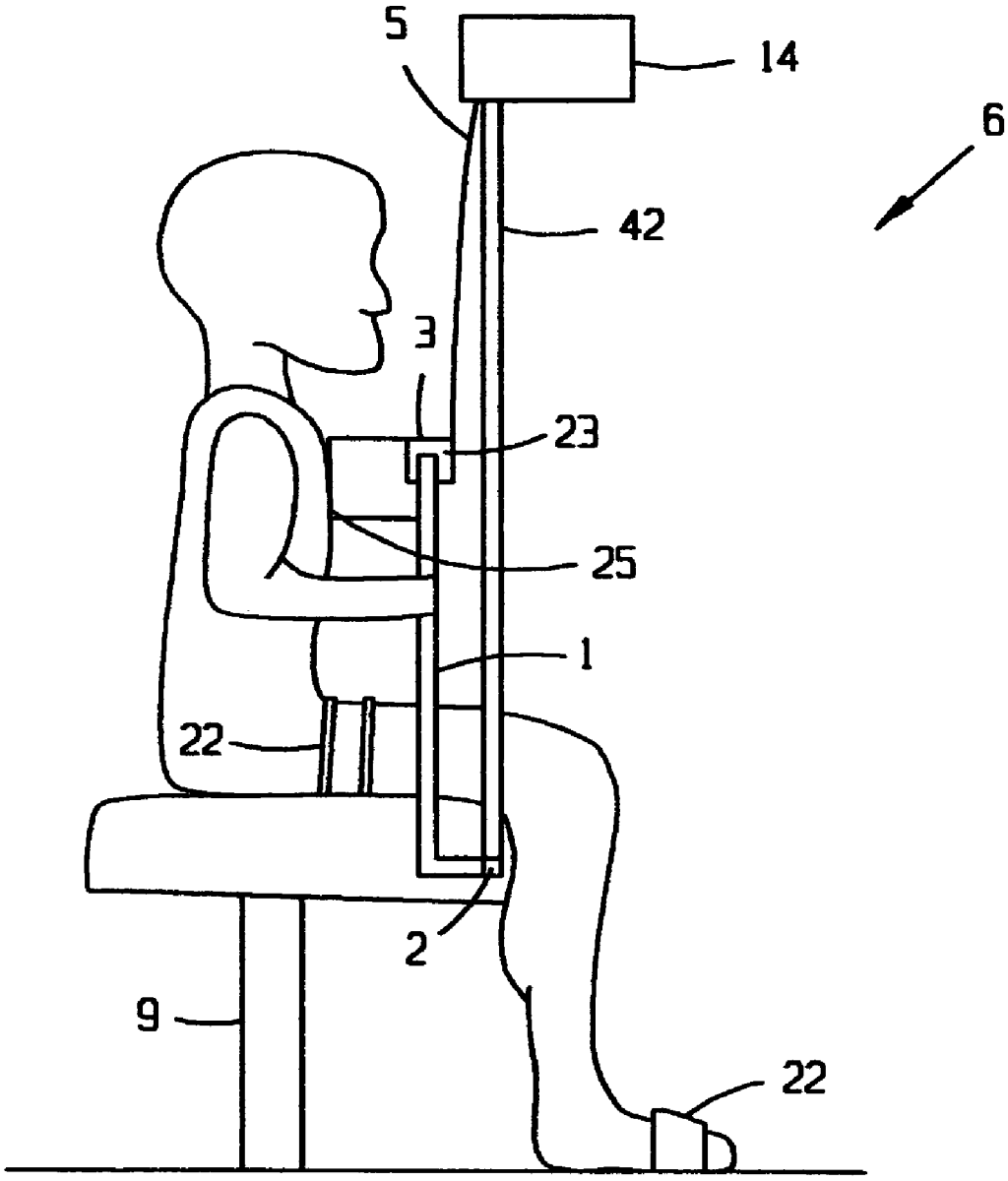
FIG. 8 is a side view of depicting an embodiment adapted to exercise the torso.
Figure 9:
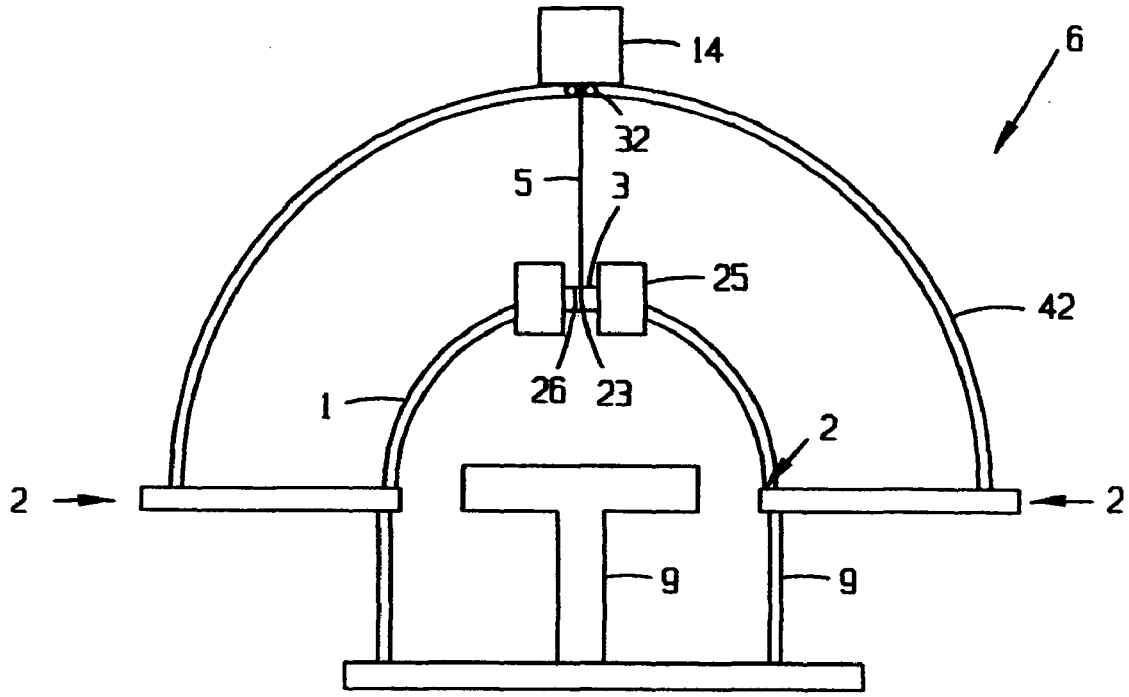
FIG. 9 is a front view further illustrating the embodiment shown in FIG. 8.

FIG. 8 is a side view and FIG. 9 is a front view of an exercise apparatus 6 having an r-a-track 1 for exercising the muscles, tendons and ligaments (connective tissue) that surrounds the lower spine, lower back, and pelvis. The exercise apparatus 6 depicted in FIGS. 8 and 9 allow a user 4 to do stomach and lower back exercises in a three dimensional arcuate motion as the chest or shoulder region moves about points defined by arcuate surface. Using the top of the pelvis as a pivot point the user 4 can rotate his upper body any direction around the pelvis and receive a selectable resistance from the exercise apparatus 6. A spreader bar (not shown) can be used to keep the lead 5 from interfering with or touching the user during exercise.

Figure 10:
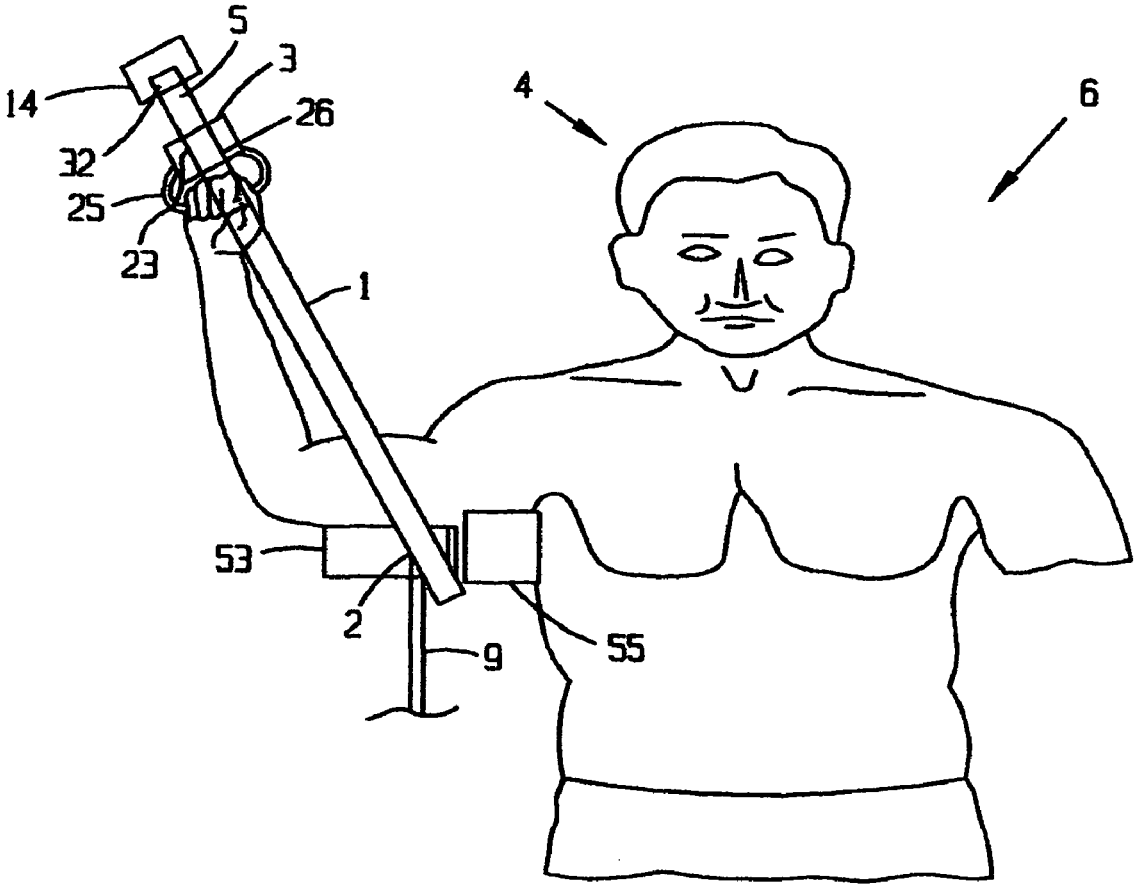
FIG. 10 is a front view illustrating an embodiment adapted to exercise the arm and shoulder region.
Figure 11:
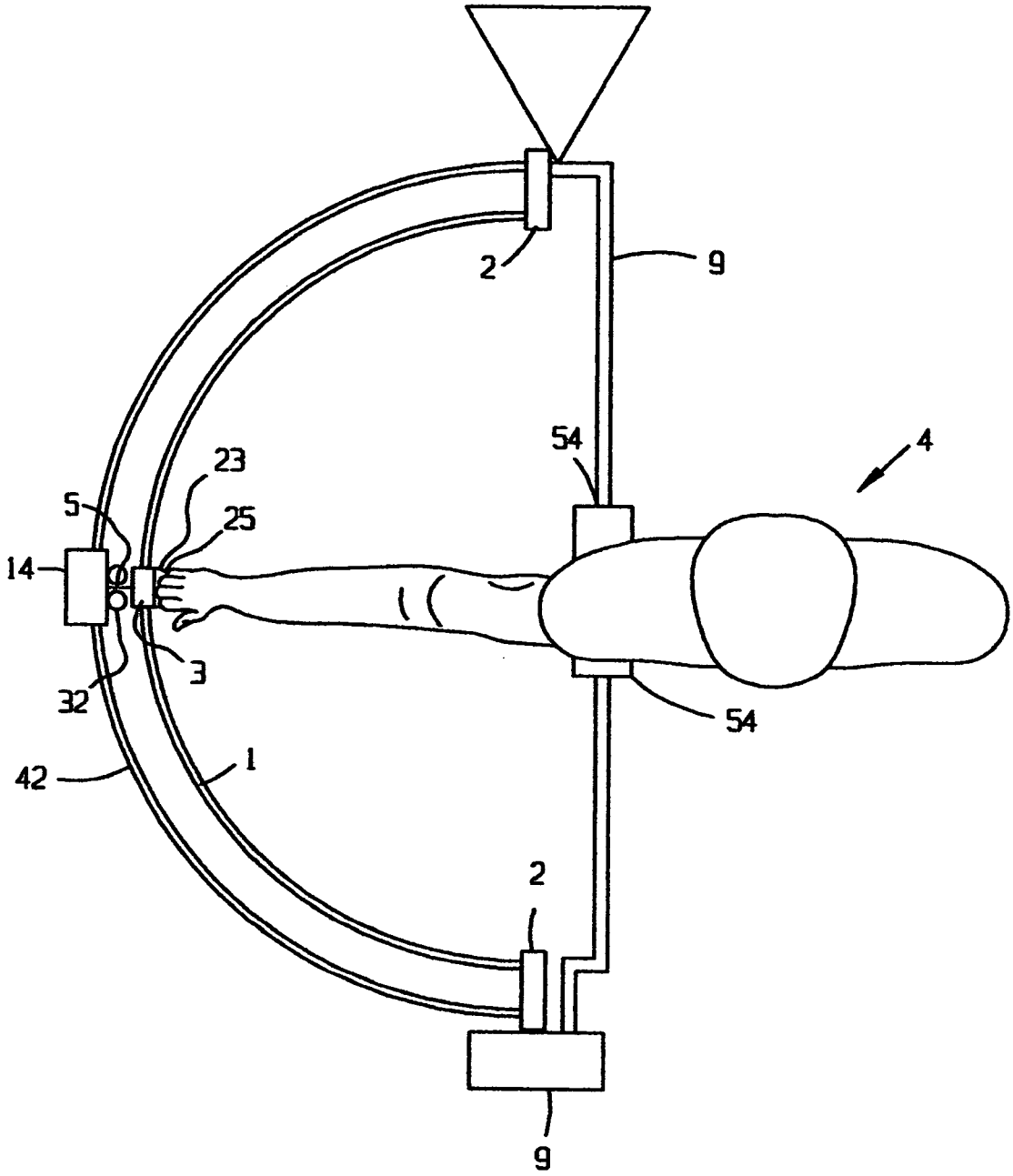
FIG. 11 is a top view further illustrating the embodiment in FIG. 10.

FIG. 10 is a front view and FIG. 11 is a side view of an exercise apparatus 6 having a r-a-track 1 adapted for exercising the muscles/ligaments and tendons of the elbow and shoulder socket. The tissue and bone connecting the shoulder to the elbow can be exercised in an arcuate motion about the center point of the shoulder socket as illustrated in FIG. 11. Further, the rotation of the arm about the shoulder, such as that of a throwing motion can be exercised as illustrated in FIG. 10. The throwing motion of one's arm and shoulder is different for each individual and can be different for each throw thus adapter 23 can effectively be utilized. The embodiment of FIG. 10 can help an athlete to repeat the same throwing motion or improve his throwing motion by placing sensors on the moving parts of the exercise apparatus 6 and recording the optimum movement and forcing the optimum movement or motion on successive throws. All muscles tendons and ligaments that hold and move the hand about the shoulder joint can be monitored and exercised. A first pad 53, second pad 54 and/or third pad 55 can be utilized to properly place or locate the user 4 in the exercise apparatus 6 prior to exercise. The pads can also stabilize the user 4 during exercise.

Figure 12:
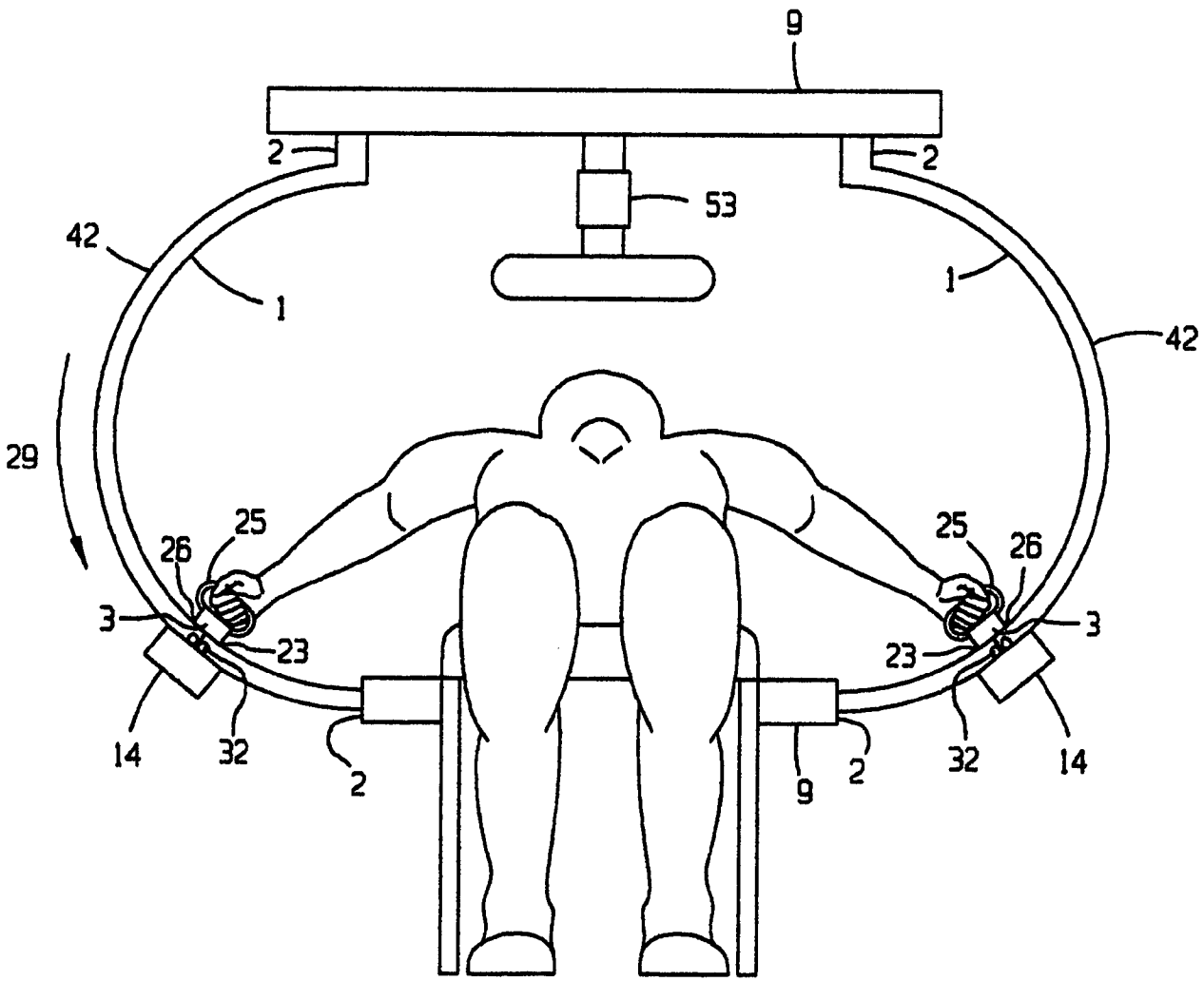
FIG. 12 is a front view illustrating an embodiment adapted to exercise both shoulders simultaneously.

FIG. 12 illustrates an exercise apparatus 6 having two arcuate tracks each. adapted to simultaneously exercising the ligaments tendons and connective tissue in the shoulders. The exercise apparatus 6 provides an exercise which is referred to in the art of weight training as "fly's." In this embodiment the user interface 25 can be implemented using handles. As in all embodiments the start location of the user interface 25 can be adjusted such that the exercise can be started at any location. First pad 53 can be adjusted down on the users chest to hold the user 4 down on the bench when the user 4 starts the exercise with both hands up and pulls down towards the ground (a motion illustrated by arrow 29) "a reverse fly."

Figure 13:
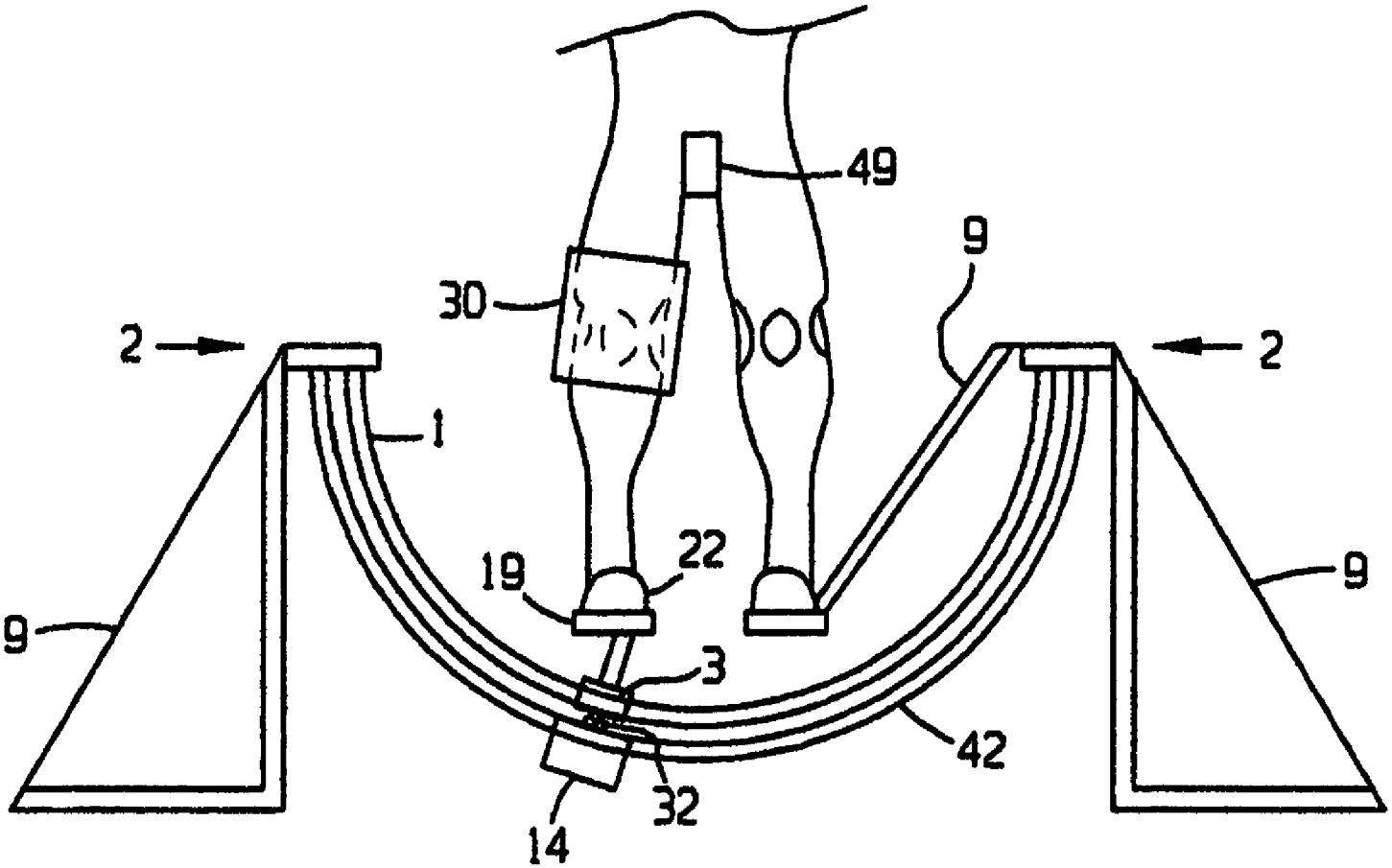
FIG. 13 is a front view depicting an embodiment for exercising the pelvis, hip and leg region.
Figure 14:
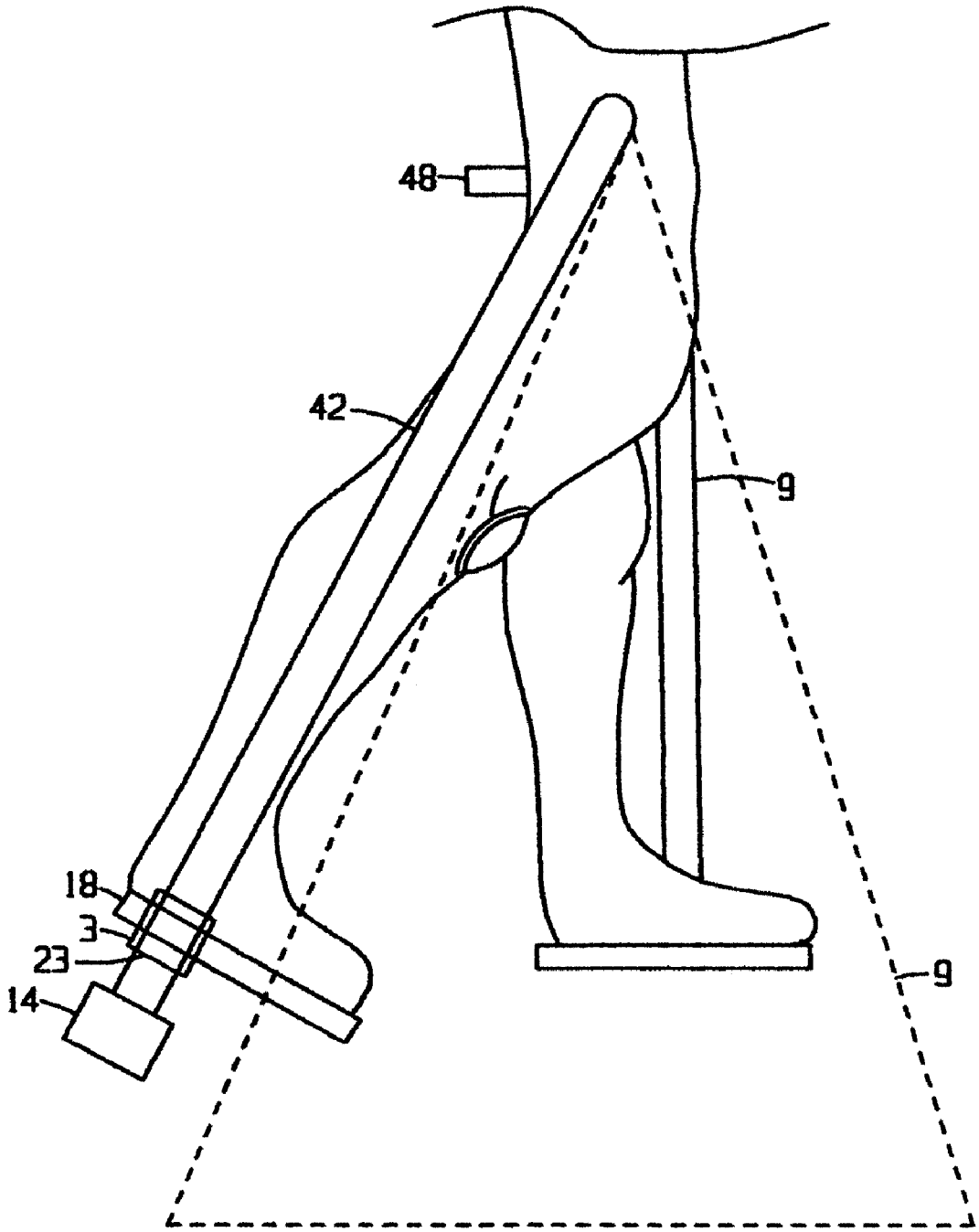
FIG. 14 is a side view further illustrating the embodiment in FIG. 13.

FIG. 13 depicts front view and FIG. 14 depicts a side view of an exercise apparatus 6 for exercising the leg/knee/hip/ankle region. An arc track embodiment is illustrated for exercising the leg/knee and/or the hip socket in conventional and unconventional directions about an arcuate surface. In one embodiment the ankle embodiment of FIG. 6 can be incorporated into the exercise apparatus 6 of FIG. 13. The user 4 can sit on seat 49 and rests one foot on frame 9 while exercising the leg. This embodiment can be useful to football and basketball players who may be prone to knee, groin, hip, and ankle injuries. The exercise apparatus 6 illustrated, allow an athlete to strengthen all connective tissue which surrounds the sockets of the leg and increase the flexibility of an all joints and connective tissue that move the toes about the hip socket.

The leg embodiment of can provide motion and resistance for a "soccer style" kicker. The kicker will be provided a selectable resistance as he swings his leg in a natural kicking motion. One foot of the user 4 is strapped to the pivot plate 19 and the other foot position can rest on frame 16. In one embodiment a knee immobilizer 30 or ankle immobilizer (not shown) can be placed over the users knee or ankle so that the joint does not move and the muscles ligament and tendons surrounding the hip joint can be isolate for exercise.

Figure 15:
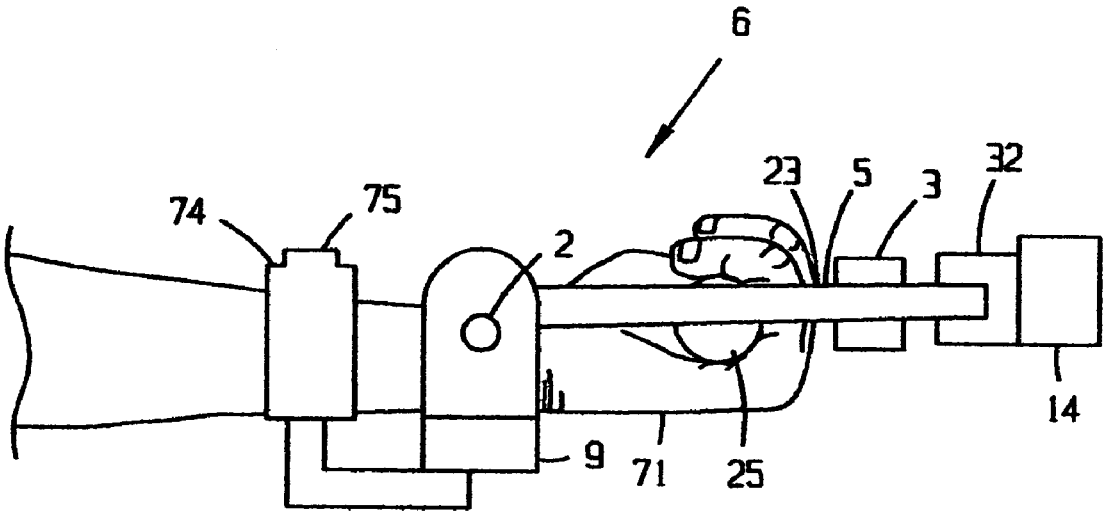
FIG. 15 is a side view of depicting an embodiment adapted to exercise the wrist region.
Figure 16:
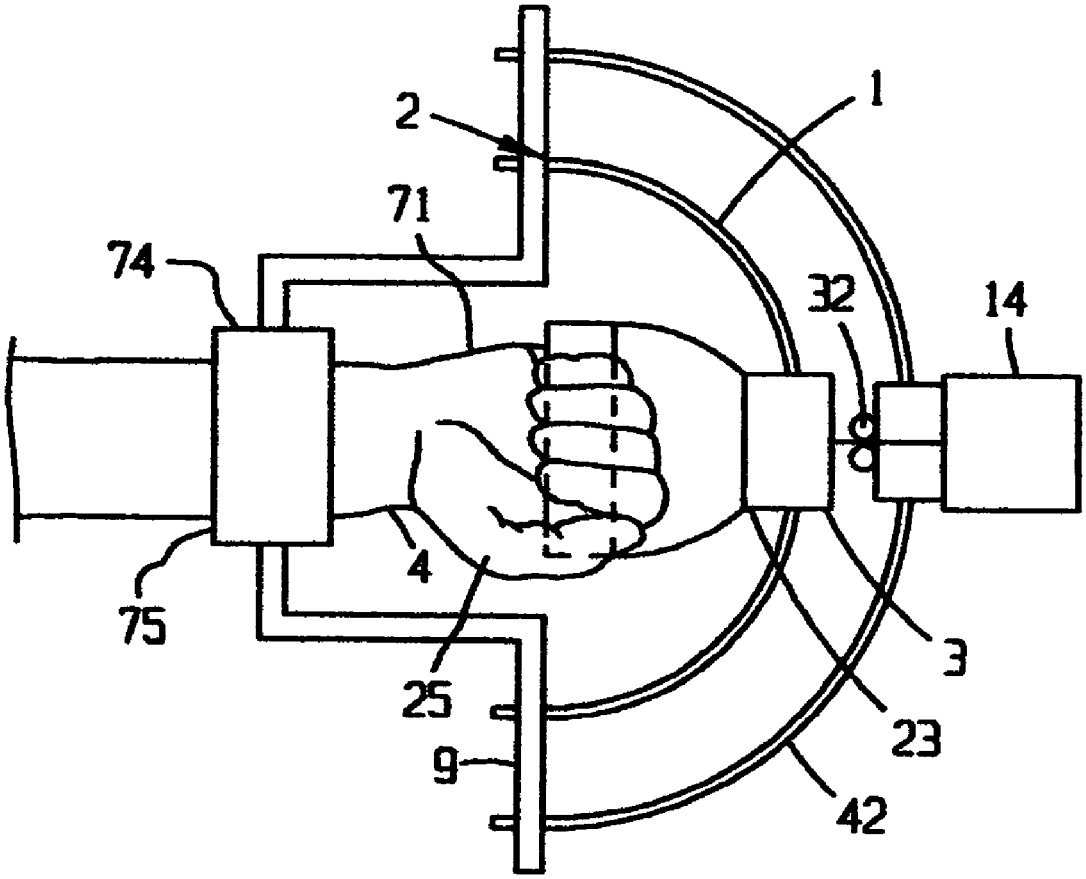
FIG. 16 is a top view further illustrating the embodiment in FIG. 15.

FIG. 15 is a side view an exercise apparatus 6 for exercising the hand and fingers 71 about the wrist and FIG. 16 is a top view of the exercise apparatus 6 in FIG. 15. FIG. 15 utilizes an arcuate track adapted to exercise the muscles ligaments and tendons the move the hand about the wrist socket. The user interface 25 can be implemented as a handgrip, a mitten (not illustrated) or any other interface which provides a push points or pull points for the user 4. A wrist exercise apparatus 6 can be utilized to test the performance of and rehabilitate individuals that have carpal tunnel problems by analyzing muscles and tendons using an medical sensors while the tissue is under load by the present invention. Using adapter 23 the wrist embodiment allows the user 4 to pronate the wrists during rotation. A securing member 74 provides a yoke for the user 4 to place his wrist in, and a strap 75 which can secure the users forearm 4 while exercising the wrist. The pivot points 2 are secured to the frame 9 such that the wrist socket can be isolated during exercise. Adapter 23 can bias the user interface 25 in the natural position of the users hand and when the hand pronates the adapter 23 can provide rotational resistance.

Figure 17:
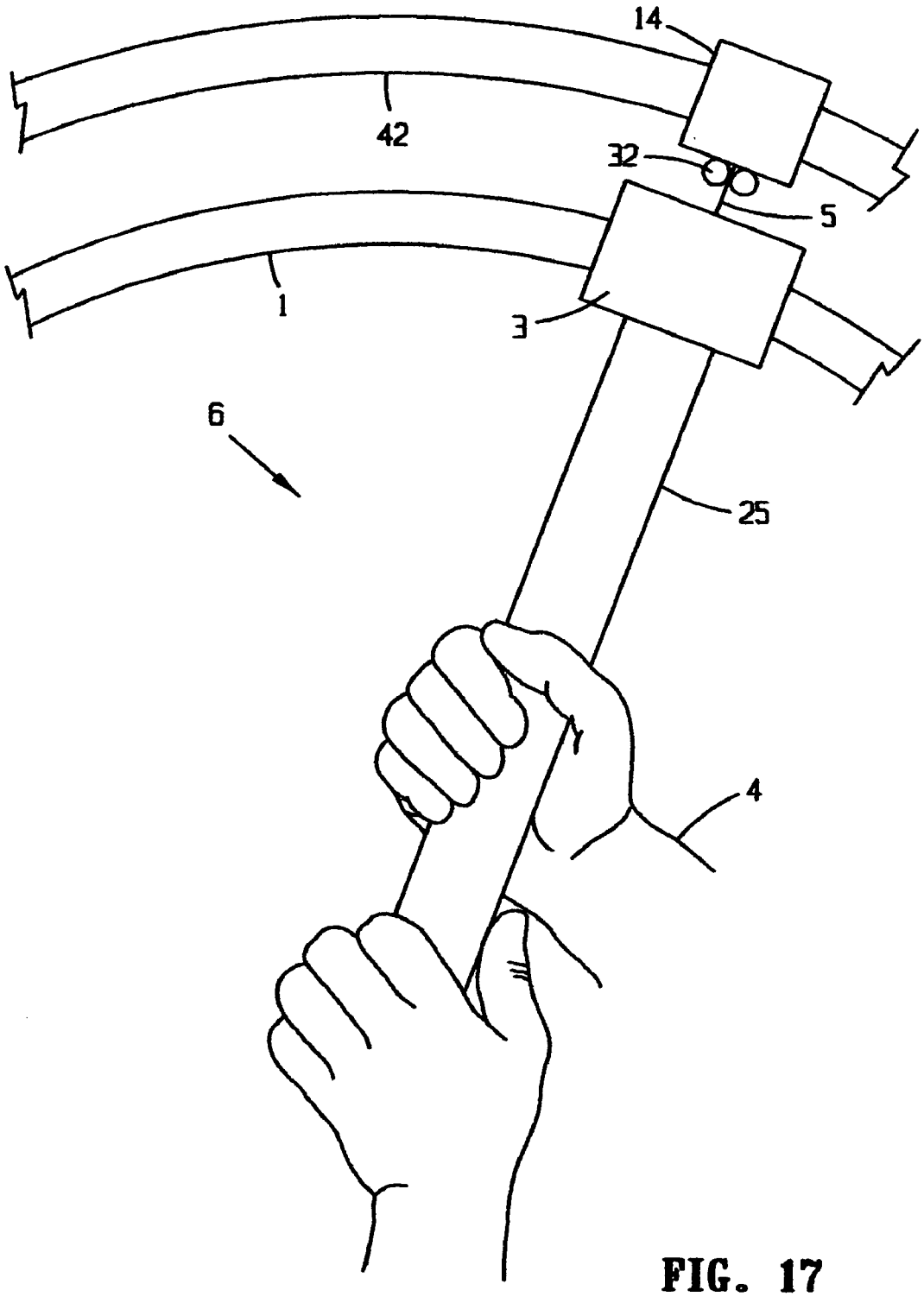
FIG. 17 is a top view of the r-a-track adapted for exercising connective tissue used in a swinging motion.

FIG. 17 depicts an exercise apparatus 6 which has a r-a-track 1 adapted to strengthen and perfect the art of swinging a sports instrument. The exercise apparatus 6 can be utilized to strengthen a swing for golf, baseball, any racket based sport or any sport that uses a swinging motion. Exercising the muscles against resistance allows a user 4 or athlete to strengthen muscles used throughout an entire swinging motion. In other embodiments the r-a-track 1 can be placed further away from the grip to simulate embodiments such as swinging a golf club. The exercise apparatus 6 illustrated in FIG. 17 could be used for swing analysis or training or in a video game. The location, position and velocity of the instrument during the swing can provide data regarding the performance of a swing. Thus, a user such as a golfer or batter can learn about the clubface or bat position and what effect altering his stance, back swing, size of instrument or other physical parameters achieve.

The features accessories and enhancements described throughout this detailed description could be utilized on each of the embodiments described in FIGS. 1-17. For example, the first member 27 or 27' and second member 28 or 28' illustrated in FIGS. 2 and 3 could be used to implement the arcuate motion of the user interface instead of the r-a-track which was used to illustrate the embodiments in FIGS. 4-17.

The foregoing is a detailed description of preferred embodiments of the invention. Various modifications and additions can be made without departing from the spirit and scope of the invention. Accordingly, this description is only meant to be taken by way of example and not to otherwise limit the scope of the invention.

The invention claimed is:

1. An apparatus comprising:

a frame;

a first member having at least one pivot point rotatable in relation to the frame about the at least one pivot point;

a second member coupled to the first member and moveable in relation to the first member;

a user interface coupled to the first member and engageable with the at least a portion of the human body, such that the first and second member confine movement of the user interface to locations defined by a three dimensional arcuate surface a resistance system coupled to the frame and;

a lead coupled to the user interface and coupled to the resistance system, the lead to extend from the resistance system a first distance as the user interface moves the first distance from the start location in a fore direction, the lead to extend from the resistance system the first distance as the user interface moves the first distance from the start location in a left direction, and the lead to extend from the resistance system the first distance as the user interface moves the first distance from the start location in a right direction, where the left and right direction are perpendicular to the fore direction.

2. The apparatus of claim 1, further comprising a fairlead coupled to the frame, the fairlead having rollers to guide the lead as it moves during the movement of the user interface.

3. The apparatus as in claim 1, further comprising an adjuster coupled to the resistance system to adjust an amount of net force required to move the user interface from the start location.

4. The apparatus as in claim 1, further including a sensor system coupled to the user interface to sense parameters related to movement of the user interface.

5. The apparatus as in claim 1, further comprising at least a third mechanical member to provide a virtual pivot point, the virtual pivot point to assist in confining movement of the user interface the locations defined by the three dimensional arcuate surface during movement of the user interface, the virtual pivot point defined by at least two hinge points where a distance between the at least two hinge points is different than a radius that defines the three dimensional arcuate surface.

6. The apparatus as in claim 1, further comprising, an adjuster to modify a path traveled by the user interface, wherein the three dimensional arcuate surface is defined by at least one radius and the adjuster can change the at least one radius.

7. The apparatus as in claim 1, further comprising at least a third member adapted to move the start location of the user interface to a different start location on the three dimensional arcuate surface.

8. An apparatus to exercise a human body appendage comprising:

a frame;

a first pivotable member, having at least one joint to pivot in relation to the frame;

a second pivotable member coupled to the first pivotable member;

a third member that in cooperation with the second pivotable member rotates the user interface as it moves away from a start location;

a user interface coupled to the second pivotable member, where movement of the user interface is restricted by the first and second pivotable members to locations defined by a three dimensional arcuate surface;

a resistance assembly coupled to the user interface and the frame to provide a substantially uniform resistance to movement of the user interface when the user interface moves away from the start location.

9. The apparatus as in claim 8, further comprising, a pivotable joint assembly to couple the user interface to the second pivotable member and to rotate the user interface as it moves from a start location such that the user interface remains tangent to a hemispherical surface in three dimensional space as it moves from the start location.

10. The apparatus of claim 8, further comprising:

a lead coupled to the resistance system; and a fairlead having rollers coupled to the resistance system to guide the lead during movement of the user interface away from the start location.

11. The apparatus of claim 8, further including sensors to monitor parameters of the apparatus.

12. The apparatus of claim 8, further comprising a fourth member to move the resistance assembly to a plurality of locations defined by a second three dimensional arcuate surface.

13. The apparatus of claim 8, further comprising a friction type resistance assembly wherein when the user interface is moved, the friction type resistance assembly provides a resistance to the movement of the user interface.

14. An apparatus comprising:

a frame;

a first member rotatable in relation to the frame;

a second member moveable in relation to the frame;

a user interface coupled to the first and second member and engageable with at least a portion of the human body, such that the first and second member restrict movement of the user interface to locations defined by a three dimensional arcuate surface in response to a net force on the user interface in any direction, the movement including a fore direction component, a left direction component and directional components that are orthogonal to the fore direction component and the left direction component wherein the three dimensional arcuate surface is defined by a radius.

15. The apparatus of claim 14, further comprising:

a resistance system to provide a substantially identical resistance to movement of the user interface as the user interface moves from the start location in one of the fore direction, the left direction, and the directions orthogonal to the fore and left directions and at various angles to the fore and left direction.

16. The apparatus of claim 15, wherein the resistance system is moveable about a second curved surface to change a start location of the user interface.

17. The apparatus as in claim 14, further comprising means for adjusting a path traveled by the user interface.

18. The apparatus of claim 1, wherein when the user interface moves from the start location in the fore direction, the left direction, and the right direction the lead to provide a substantially similar resistance to the movement of the user interface from the start location in each of the fore direction, the left direction and the right direction.

19. The apparatus of claim 1, wherein the user interface moves the first distance from the start location in an aft direction, the aft direction opposite the fore direction.

20. The apparatus of claim 8, wherein the user interface is movable in an infinite number of directions from the start location.

21. The apparatus of claim 20 wherein the resistance assembly provides substantially uniform resistance to movement of the user interface when the user interface is moved from the start location about the three dimensional arcuate surface.

* * * * *